US006981785B1

(12) United States Patent
Watchulonis

(10) Patent No.: US 6,981,785 B1
(45) Date of Patent: Jan. 3, 2006

(54) LANTERN LOCK

(76) Inventor: Daniel Watchulonis, 112 E. Knight St., Collingswood, NJ (US) 08108

( * ) Notice: Subject to any disclaimer, the term of this patent is extended or adjusted under 35 U.S.C. 154(b) by 0 days.

(21) Appl. No.: 10/825,939

(22) Filed: Apr. 16, 2004

Related U.S. Application Data

(60) Provisional application No. 60/463,941, filed on Apr. 18, 2003.

(51) Int. Cl.
*F21V 1/06* (2006.01)

(52) U.S. Cl. ..... 362/352; 362/363; 362/396

(58) Field of Classification Search ..... 362/352, 362/353, 355, 356, 357, 358, 361, 363, 396, 362/417, 448, 450, 806, 189
See application file for complete search history.

(56) References Cited

U.S. PATENT DOCUMENTS 4,275,434 A * 6/1981 Borowitz ..... 362/352
4,562,521 A * 12/1985 Noguchi ..... 362/433
5,588,741 A * 12/1996 Huang ..... 362/417
5,791,773 A * 8/1998 Babineaux ..... 362/352
5,873,651 A * 2/1999 Hofer et al. ..... 362/396
5,893,636 A * 4/1999 Babineaux ..... 362/352
2002/0075688 A1 * 6/2002 Moser ..... 362/396

* cited by examiner

*Primary Examiner*—Y. My Quach-Lee
(74) *Attorney, Agent, or Firm*—Jessica Costa

(57) ABSTRACT

A novel lantern lock for holding a light and its light shade in a fixed position when mounted on standard lighting equipment is presented. The lantern lock includes a socket assembly with a light bulb socket and power cord. A spreading frame is fixedly attached to the socket assembly, and when a shade is mounted thereon, holds the shade in a fixed position relative to the socket assembly. In one embodiment, the socket assembly is mounted on a base and mounting stud is physically attached to the socket assembly. In an alternative embodiment, a clamp clamps at least a portion of the socket assembly, and the mounting stud is attached to the clamp. The mounting stud is compatible with standard lighting equipment mounting devices, such as a C-clamp mountable on an extension arm of a C-stand. The C-clamp may be rotated in any position to fix the position of the mounting stud, and to thereby fix the position of the light.

13 Claims, 8 Drawing Sheets

LANTERN LOCK

This application claims the benefit of priority from U.S. Provisional Patent Application Ser. No. 60/463,941 filed Apr. 18, 2003.

BACKGROUND OF THE INVENTION

The present invention relates generally to film and video production lighting, and more particularly to a lantern lock for locking a hanging-style lamp into a fixed but controllable position.

Lamps are standard equipment in the film and video production industry. Different lighting is used for different purposes. Some productions require the use of diffused lighting. One way of achieving this effect is through the use of a lantern having an accordion-style shade (sometimes referred to as a "Chinese lantern"). As known by those in the lighting and film industries, an accordion-style shade lantern includes a shade having a material such as rice paper or cloth collapsibly attached to a plurality of ribs, which when fit over a lamp spreader, spread out to form an expanded lantern. The accordion-style lantern may take on various shapes, such as spherical or global, box-shaped, etc. The shape and configuration of the lantern shade ribs, will vary from design to design. For example, in a spherical accordion-style lantern shade, the ribs will typically be concentric wire rings that are connected together via material such as rice paper, ribbon, cloth, etc. The flexibility of the material allows the lantern shade to collapse into a fully collapsed position, (e.g., planar) and to expand to a fully expanded position (e.g., a sphere for a spherical accordion-style lantern shade, or a 3-dimensional box shape for a box-shaped accordion-style lantern shade). When used, the shade is mounted on a spreader frame which expands and retains the shade in its fully expanded position. A light bulb socket assembly with a power cord is attachable to the shade. Light emitted by the bulb is diffused by the shade and ideal lighting for certain types of filming.

One problem with the current design of such lanterns is the hanging assembly. The power cord that attaches to the socket assembly is designed to operate not only to power the lantern bulb, but also to attach to a ceiling hook to hang down from the ceiling. This design is problematic for the film and video industries for several reasons. First, it is oftentimes desirable to position the lantern in positions other than hanging from a fixed point of a ceiling. However, no means exist for positioning the lantern from below, from the side, or at any other angle. In addition, without additional stabilizing equipment, the lamp is susceptible to undesirable swinging due to its hanging configuration (for example, due to natural or artificial wind, or from people or objects unintentionally bumping into the lamp). Accordingly, a need exists for a technique for a locking a hanging-style lamp into a fixed but controllable position. It would be desirable if such technique included a means for interfacing the lock to standard lighting stands and equipment that are already and readily available.

SUMMARY OF THE INVENTION

The present invention is a novel lighting device for the film and video production industry. The invention is a lantern lock assembly that replaces or attaches to the socket assembly of a hanging-style lamp and which locks a lamp into a fixed position relative the lantern lock. The lantern lock assembly includes a clamping device that allows the lamp to be fixedly positioned relative the clamp. Accordingly, the lamp may be positioned in a variety of positions limited only by the number of clampable positions.

In the preferred embodiment, the lantern lock replaces the hanging socket assembly and spreading unit of a hanging lantern of the type having an accordion-style lamp shade. In this embodiment, the lantern lock includes a corded light bulb socket fixedly attached to an accordion-style lamp shade spreader. The lantern lock also includes a stud that is matable with a clamping device. In the preferred embodiment, the stud is ⅝" and designed to be clamped and held by standard film and video production accessories which accept a ⅝" or ¾" stud, such as a Mathews "C stand" with griphead.

In operation, a light bulb such as a standard-base 24 bulb or a floodlight is screwed into the lantern lock socket and an accordion-style lamp shade is fit over the spreader and hooked into position. The lantern lock stud is inserted and locked into a clamping device. In the preferred embodiment, the clamping device is a C stand griphead mounted on a "C" stand. The C stand griphead is adjusted to position the lamp into the desired position with precision control. The lamp is powered by plugging the lantern lock power cord into a power source such as a standard outlet.

The lantern lock is advantageous for several reasons. First, because the lantern lock is clampable, a lamp originally designed for hanging on a cord is positionable in any desired position. In addition, because the lantern lock fixes the lamp relative to the lock, the lamp is prevented from swinging.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1C:
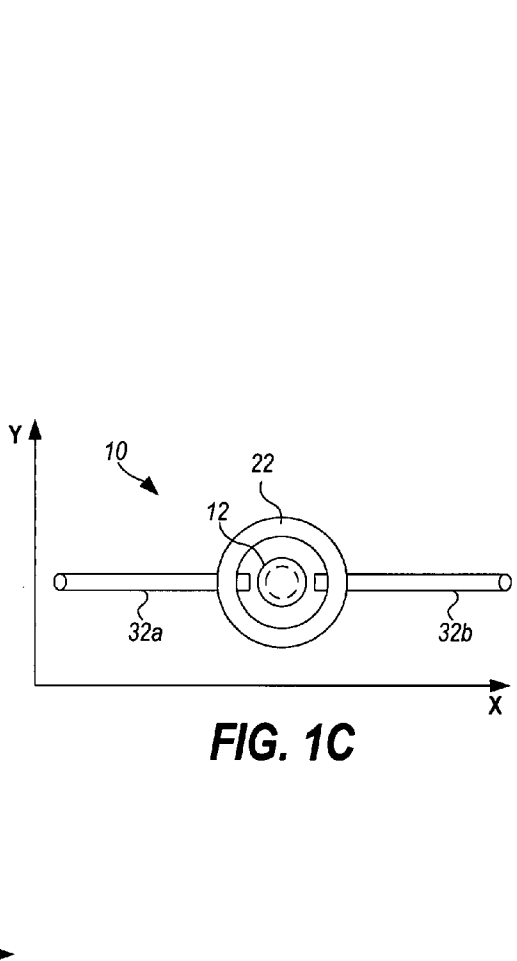
FIG. 1C is a cross-sectional view of the lantern lock of FIGS. 1A and 1B, illustrating the view from the x-y plane when looking up from the bottom of the lantern lock.
Figure 1B:
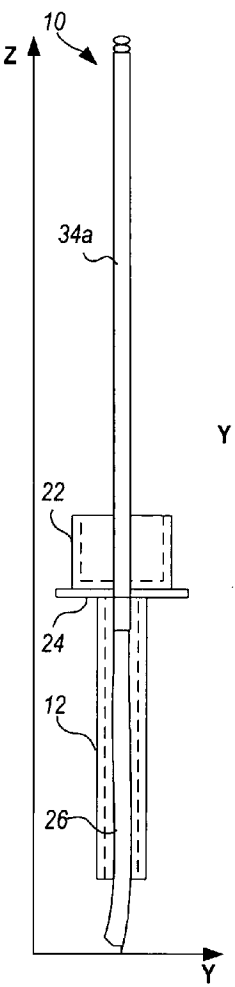
FIG. 1B is a cross-sectional view of the lantern lock of FIG. 1A, illustrating the view from the y-z plane.
Figure 1A:
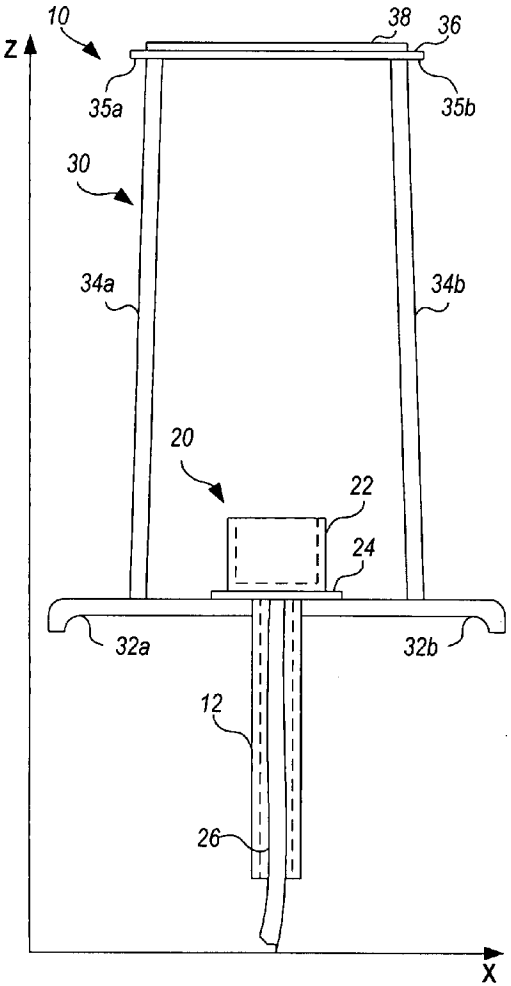
FIG. 1A is a cross-sectional view of a preferred embodiment of a lantern lock implemented in accordance with the invention, illustrating the view from the x-z plane.

Turning now to the drawings, FIGS. 1A, 1B, and 1C illustrate a preferred embodiment of a lantern lock 10 implemented in accordance with the invention, showing the view of the x-z plane, the y-z plane, and the x-y plane, respectively. As illustrated, the lantern lock 10 includes a mounting stud 12 attached to a socket assembly 20. The socket assembly 20 includes a threaded light bulb socket 22 attached to a base 24 and a power cord 26 electrically attached to the socket 22. In the preferred embodiment, the mounting stud 12 is a hollow cylindrical tube, and the power cord 26 is threaded through the tube, which is welded to the base 24.

The lantern lock 10 also includes a spreading frame 30 fixedly attached to the mounting stud 12. In the preferred embodiment, the shade 5 (FIG. 2) to be mounted onto the spreading frame 30 is an accordion-style global shade having a material such as rice paper or cloth collapsibly attached to a plurality of concentric wire ring pairs. Accordingly, the spreading frame 30 is an accordion-style global shade spreader. The spreading frame 30 comprises two hooks 32*a*, 32*b* extending perpendicularly from the mounting stud 12, two extension arms 34*a*, 34*b* and a hook arm 36 and a stabilizing rod 38. In the preferred embodiment, the hooks 32*a*, 32*b* are attached via welding or screws to the bottom of the socket assembly base 24. The two extension arms 34*a*, 34*b* are attached at their first ends symmetrically on and perpendicular to the hooks 32*a*, 32*b*. The hook arm 36 is attached perpendicular to and across the second ends of the two extension arms 34*a*, 34*b*. The stabilizing rod 38 is attached parallel to and on top of the hook arm 36. The hook arm 36 includes two hooks 35*a*, 35*b*.

In the preferred embodiment, the socket assembly 20 comprises a standard ceramic light socket 22 with a 14 Awg wire power cord 26. The mounting stud 12 comprises a ⅝" or ¾" steel tube having 3⁄32" walls. The spreading frame 30, including the hooks 32*a*, 32*b* is made of 3⁄16" mild steel wire. The global shade 5 is preferably a 11¾", 17", 22", or other standard diameter sized accordion-style global lantern shade.

Figure 2:
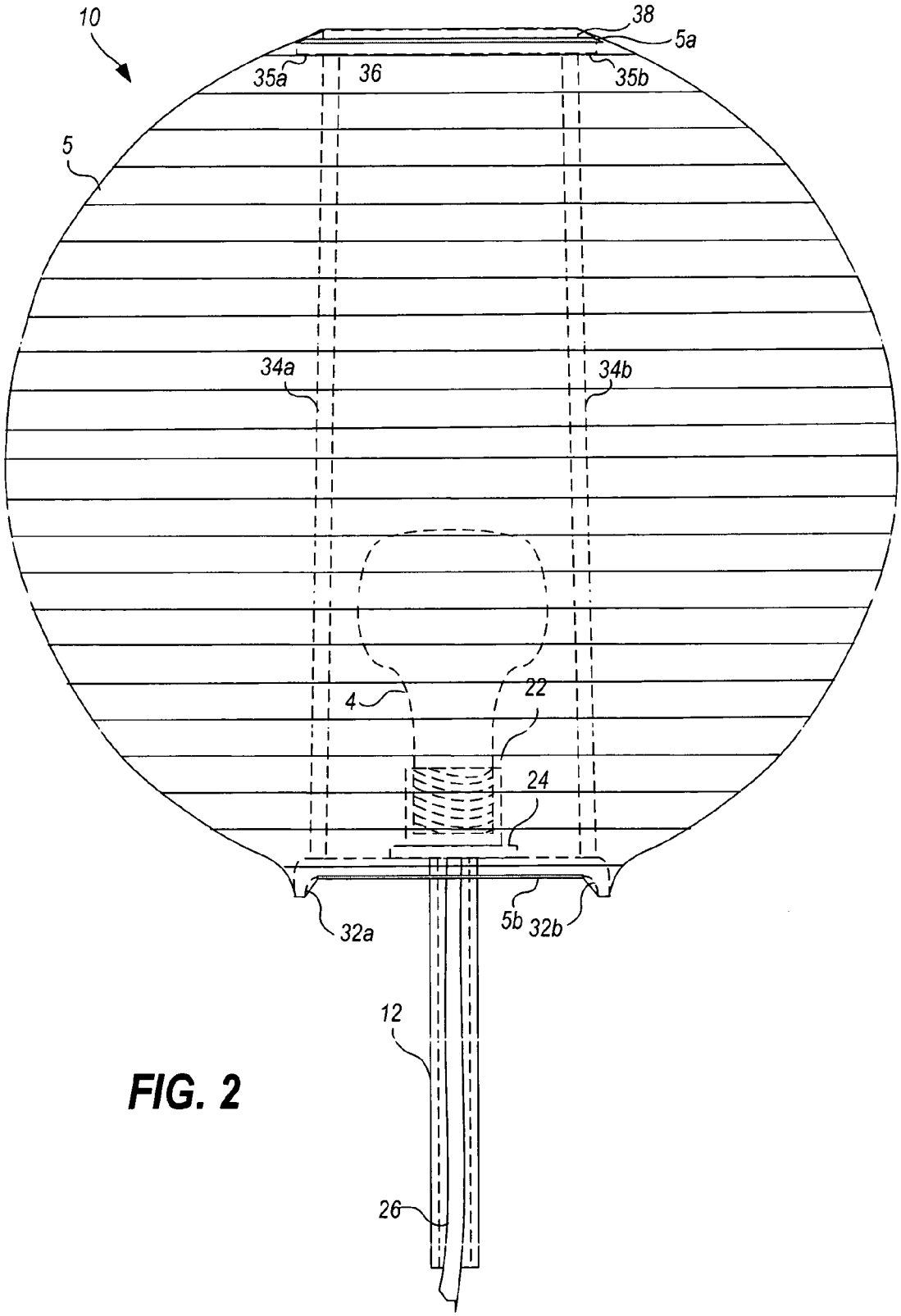
FIG. 2 is a cross-sectional view of a preferred embodiment of a lantern lock implemented in accordance with the invention, illustrating the view from the x-z plane, with a bulb and shade mounted thereon.

FIG. 2 illustrates the lantern lock 10 with a light bulb 4 inserted into the socket 22 such that it is electrically connected to the power cord 26 of the shade 5. FIG. 2 also illustrates a global style—style shade mounted onto the spreading frame 30 of the lantern lock 30. As shown, the lantern lock 10 is inserted into a first open end of the shade 5. The hooks 35*a*, 35*b* of the hook arm 36 engage the smallest concentrical ring 5*a* of the shade. As the lantern lock 10 is inserted into the shade 5, the two extension arms 34*a*, 34*b* begin to push open the collapsed shade 5. The lantern lock 10 is inserted inside the shade until the hooks 32*a*, 32*b* engage and springably slip over the opening concentric ring 5*b* of the shade 5. At this point, the shade is fully open and securedly mounted over the spreading frame 30 of the lantern lock, as shown in FIG. 2.

Figure 3A:
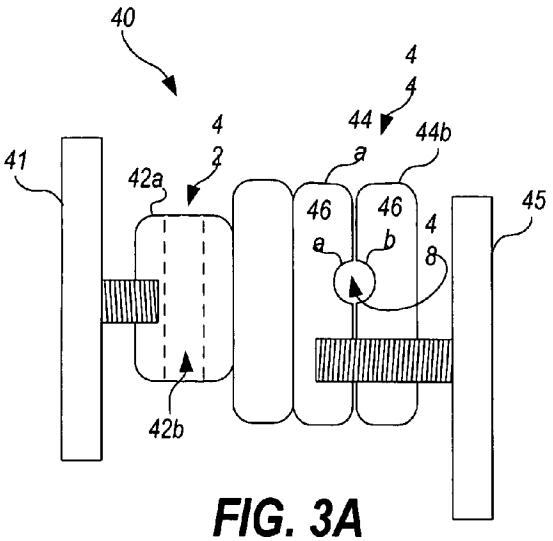
FIG. 3A is a cross-sectional view of an griphead used to fixedly position the lantern lock to a C-stand.
Figure 3B:
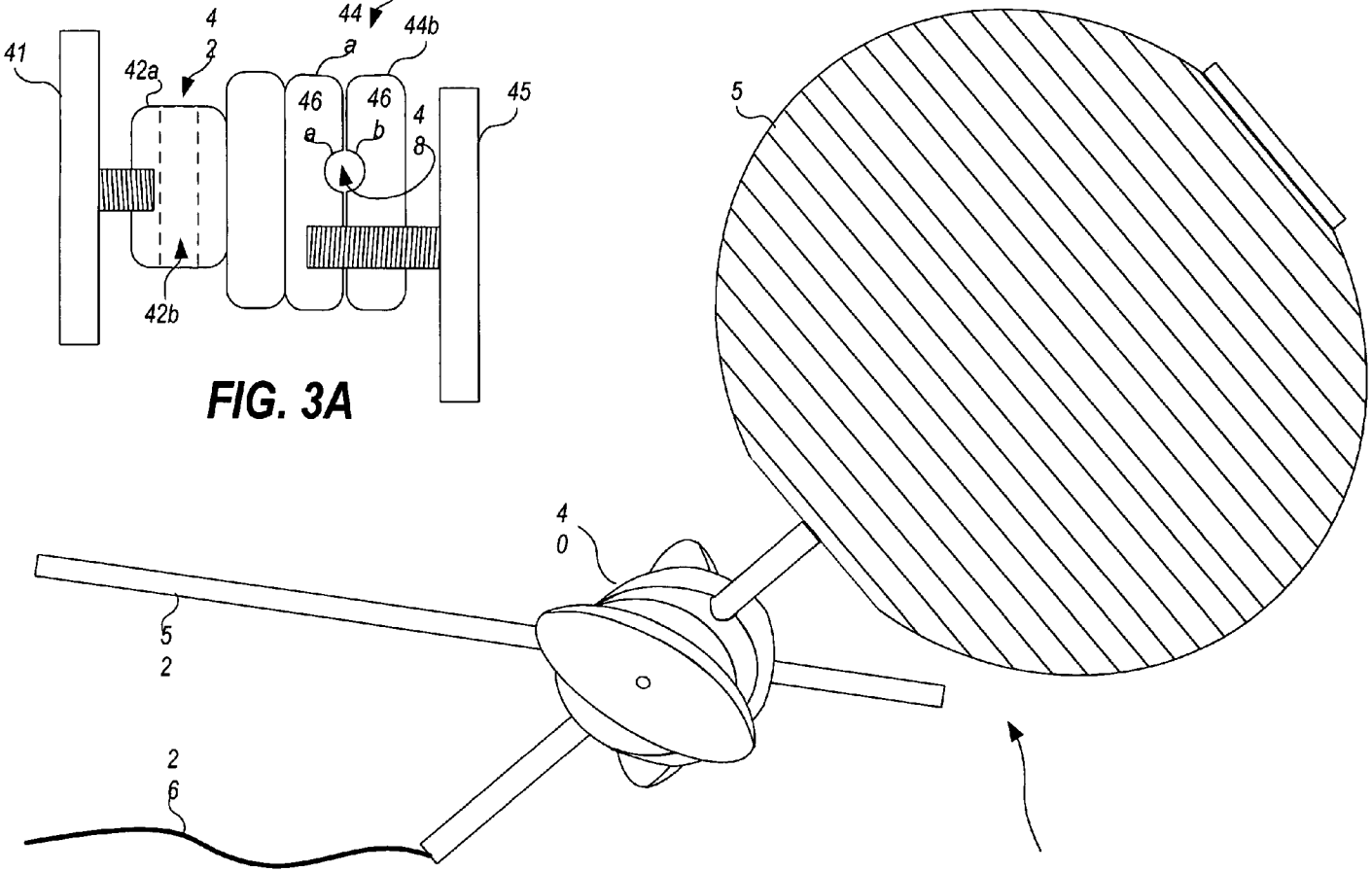
FIG. 3B is a perspective view of the lantern lock of the invention clamped by the griphead of FIG. 3A.

FIG. 3A is a top cross-sectional view, and FIG. 3B is a perspective view, of an example griphead 40 that may be used in the filming and lighting industry to attach a device to a C-stand 50 (see FIGS. 4A–4D). As illustrated in FIG. 3A, the griphead 40 includes an arm clamp 42 attached to a C-clamp 44. The arm clamp 42 includes an arm support 42*a* that includes a hollow tunnel 42*b* through which an extension arm 52 may be inserted, and a T-knob 41 that screws through the arm support 42*a* and into the tunnel 42*b* at an angle perpendicular to the axis of the tunnel 42*b*. When an extension arm 52 is inserted into the hollow tunnel 42*b* of the arm support 42*a*, the T-knob 41 may be turned in a first direction (e.g., clockwise) direction to tighten the screw so as to securedly attach the griphead 40 to the extension arm 52, and may be turned in a second direction (e.g., counterclockwise) direction to loosen the screw so as to be able to remove the extension arm 52 from the griphead 40.

The C-clamp 44 includes a first block 44*a* attached to the arm clamp 42, which has a groove formed therein in the cross-sectional shape of a half-circle, or "C". The C-clamp 44 also includes a second block 44*a* which has a similar groove formed therein in the cross-sectional shape of a half-circle, or "C". The blocks 44*a* and 44*b* are positionable such that the grooves 46*a*, 46*b* align to form a hollow substantially circular tube 48 through which a mounting stud 12 of appropriate diameter may be inserted into the tube 48. The clamp blocks 44*a* and 44*b* may then be tightened, via a T-knob 45, to form a secure grip around the mounting stud 12. Alternatively, a locking pin mechanism may be used to fix the position of the mounting stud 12 within the tube 48. Locking pin mechanisms are well known in the art.

FIG. 3B illustrates the lantern lock 10 of the invention inserted into the C-clamp 44 of the griphead 40. The angles of the extension arm 52 and the mounting stud 12 of the lantern lock 10 mounted in the C-clamp 44 are adjustable by loosening (or unscrewing) the respective T-knobs 41, 45, adjusting the angle of the extension arm 52 and the mounting stud 12 of the lantern lock 10 to the desired relative angles, and then tightening (or screwing in) the respective T-knobs 41, 45 until the respective extension arm 52 and the mounting stud 12 are fixed in position.

In the preferred embodiment, the T-knob 45 of the griphead clamp 44 allows the clamp 44, and therefore the lantern 10, to be precision positioned substantially in any angular position along the plane of the extension grip arm 52. In the preferred embodiment, the tube 48 of the griphead C-clamp 44 accepts a ⅝" or ¾" stud and a locking pin.

Figure 4B:
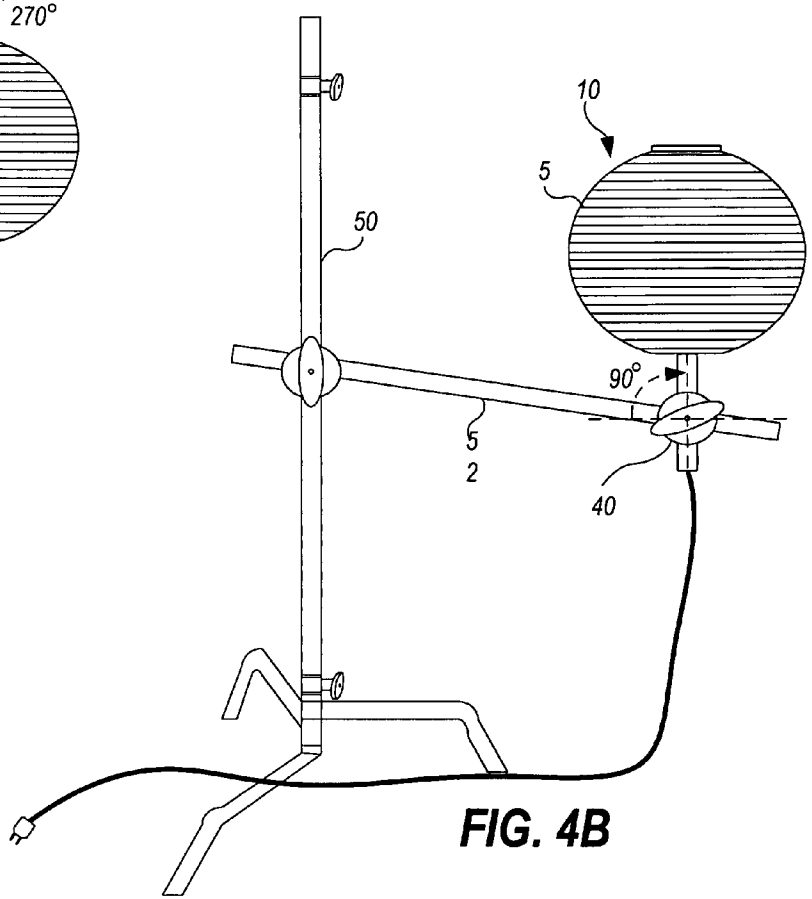
FIG. 4B is a perspective view of the lantern lock of the invention mounted on a C stand using a griphead and positioned at approximately 90°.
Figure 4A:
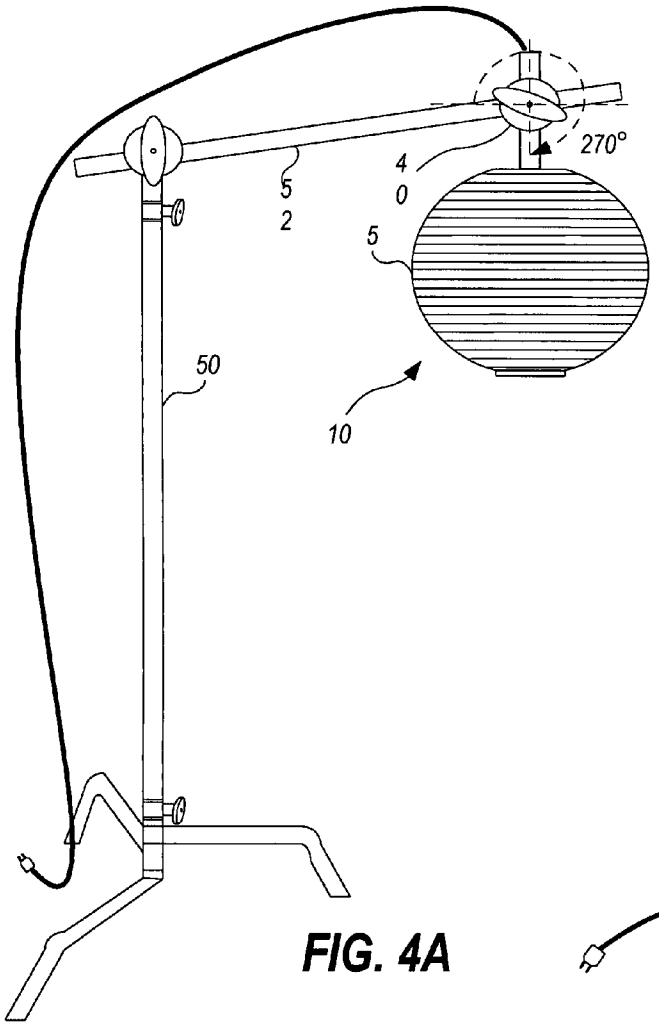
FIG. 4A is a perspective view of the lantern lock of the invention mounted on a C stand using a griphead and positioned at approximately 270°.

FIG. 4A illustrates the lantern lock 10 precision positioned by a griphead 40 of an extension grip arm 52 mounted on a C stand 50 with the lantern 10 (and therefore shade 5) positioned at approximately 270° in a 360° circle, as illustrated (assuming 0° is the left horizontal). The mounting of the mounting stud 12 of the lantern lock 10 in the grip head 40 prevents movement of the lantern in any direction; thus, the lantern will not swing regardless of air currents or movement of objects around it.

FIG. 4B illustrates the lantern lock 10 precision positioned by the griphead 40 of the extension grip arm 52 mounted on the C stand 50 with the lantern 10 (and therefore shade 5) positioned at approximately 90° in the 360° circle.

Figures 4C, 4D:
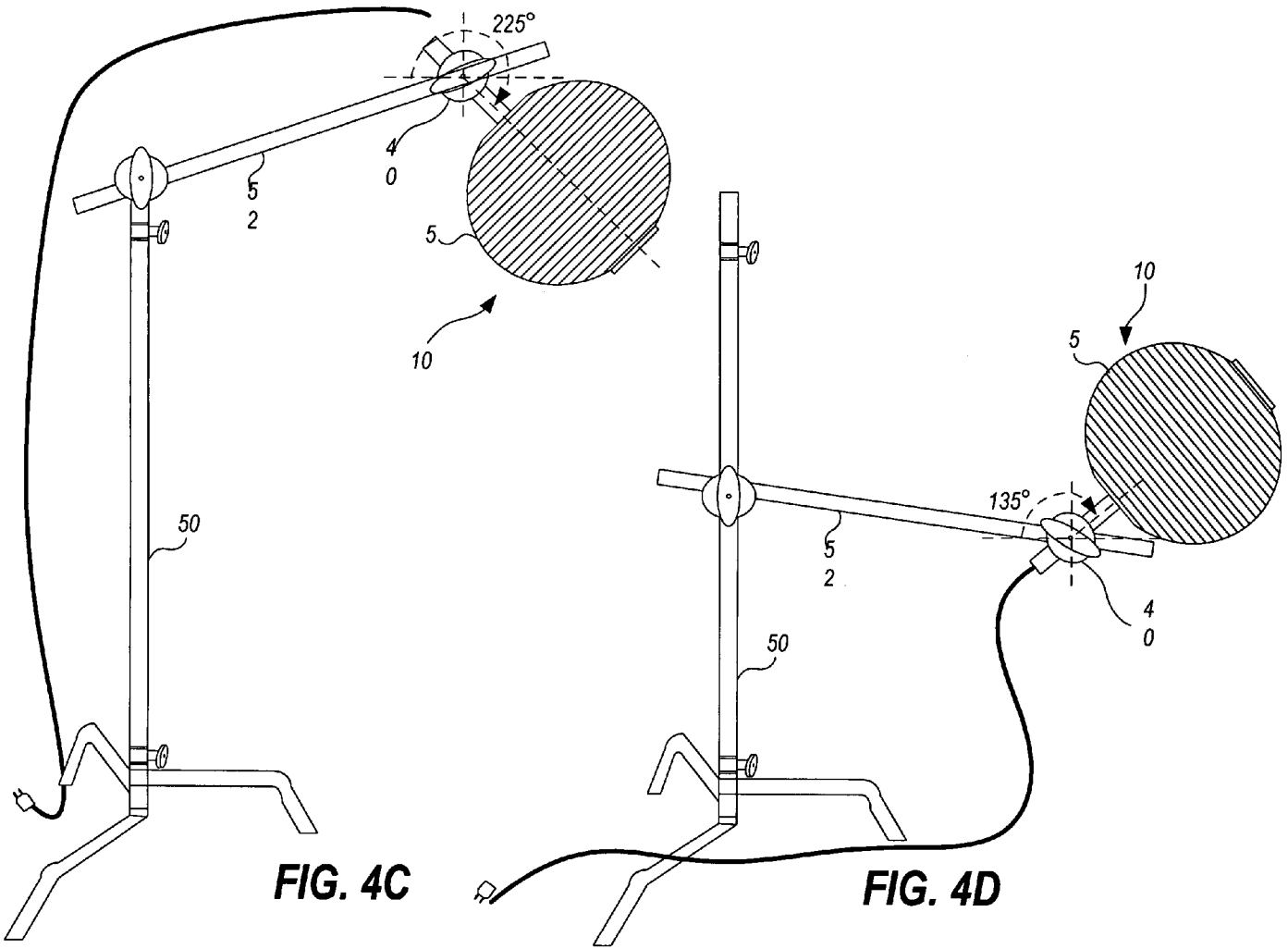
FIG. 4C is a perspective view of the lantern lock of the invention mounted on a C stand using a griphead and positioned at approximately 225°.
FIG. 4D is a perspective view of the lantern lock of the invention mounted on a C stand using a griphead and positioned at approximately 135°.

FIG. 4C illustrates the lantern lock 10 precision positioned by the griphead 40 of the extension grip arm 52 mounted on the C stand 50 with the lantern 10 (and therefore shade 5) positioned at approximately 225° in the 360° circle.

FIG. 4D illustrates the lantern lock 10 precision positioned by the griphead 40 of the extension grip arm 52 mounted on the C stand 50 with the lantern 10 (and therefore shade 5) positioned at approximately 135° in the 360° circle.

As will be appreciated by the above description of the invention, the lantern lock 10 is advantageous over the prior art by offering a full range of lantern positioning possibilities (limited only by the positioning limitations of the clamp) and ensures that the lantern is locked into the chosen fixed position.

Figure 5B:
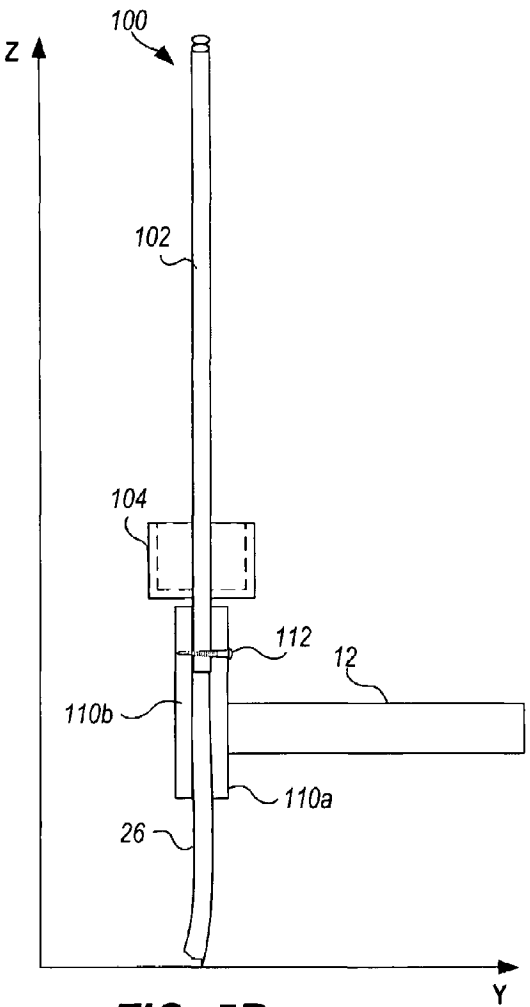
FIG. 5B is a cross-sectional view of the lantern lock of FIG. 5A, illustrating the view from the y-z plane.
Figure 5A:
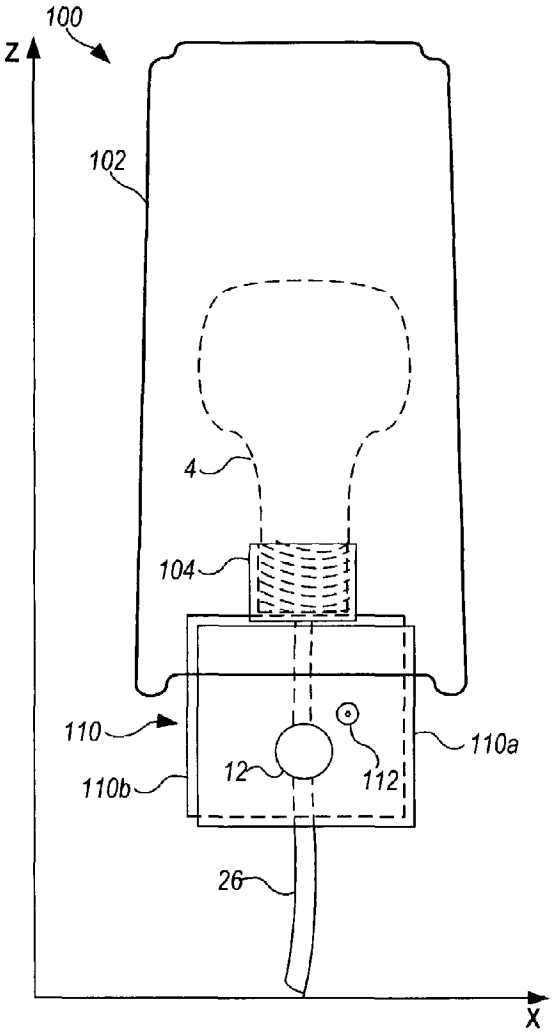
FIG. 5A is a cross-sectional view of an alternative embodiment of a lantern lock implemented in accordance with the invention, illustrating the view from the x-z plane, with the clamp assembly clamping the power cord assembly.
Figure 5C:
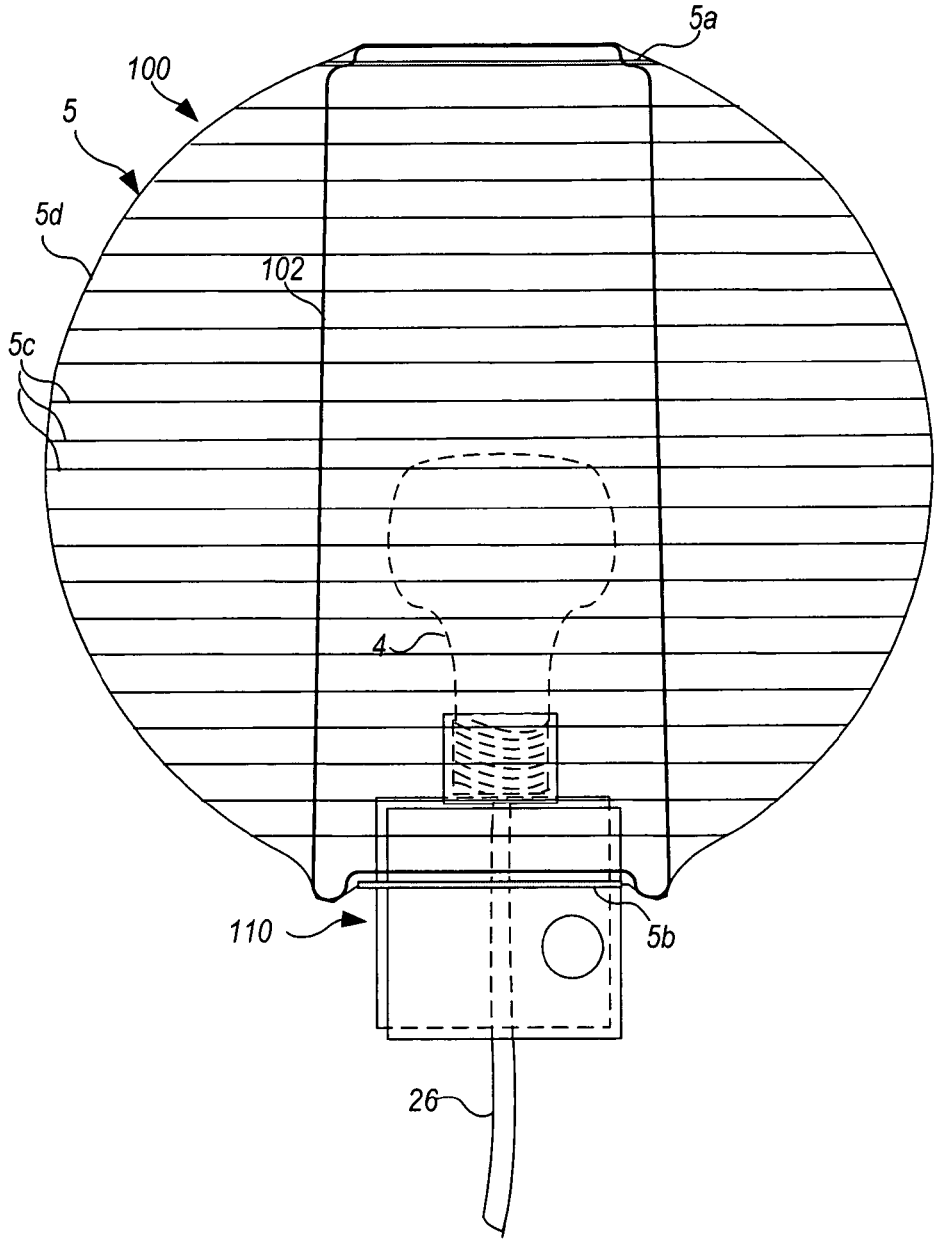
FIG. 5C is a cross-sectional view of the lantern lock of FIGS. 5A and 5B, illustrating the view from the x-z plane, with a light shade mounted thereon.
Figure 5E:
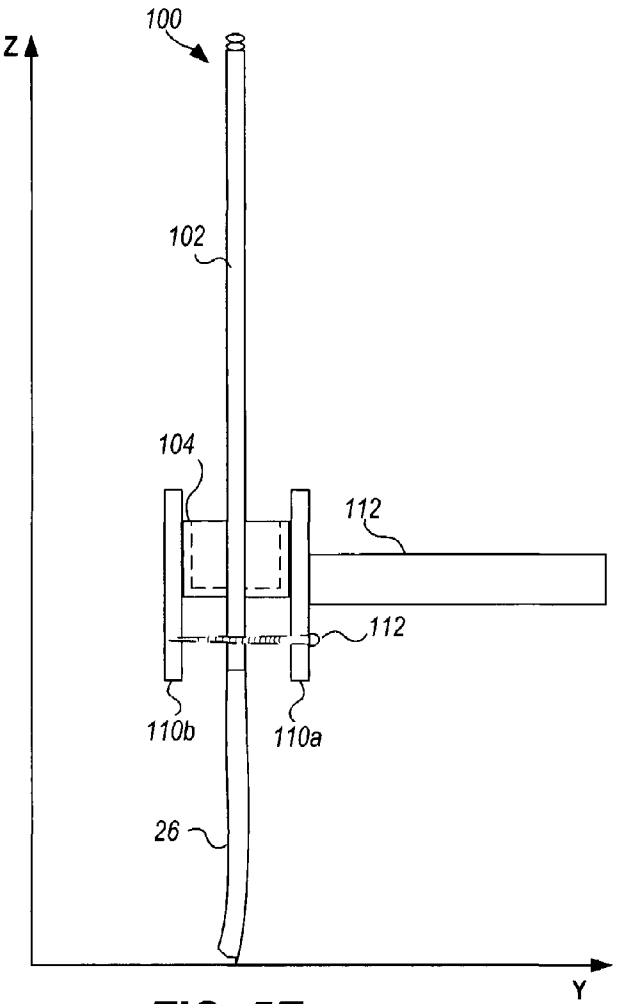
FIG. 5E is a cross-sectional view of the lantern lock of FIG. 5D, illustrating the view from the y-z plane.
Figure 5D:
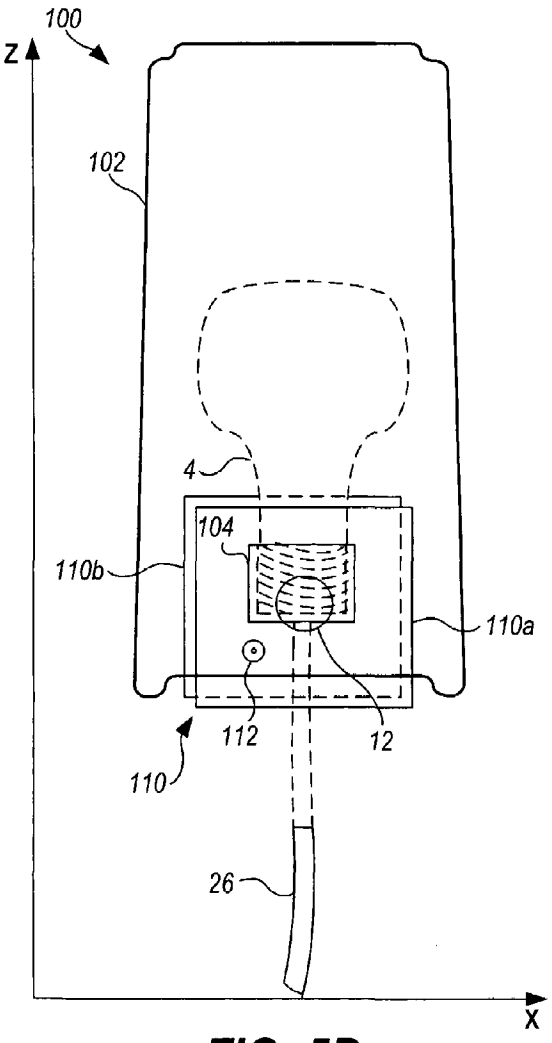
FIG. 5D is a cross-sectional view of the lantern lock of FIGS. 5A and 5B, illustrating the view from the x-z plane, with the clamp assembly clamping the socket assembly.

FIGS. 5A–5E illustrate an alternative embodiment of a lantern lock 100 implemented in accordance with the invention. As illustrated, in this embodiment, the lantern lock 100 comprises a frame 102 over which an accordian-style light shade 5 is spread and held, as illustrated in FIG. 5C. The light shade is preferably an accordian-style light shade 5 comprising a plurality of ribs 5*c* supporting a flexible material 5*d* with desired light diffusion properties. The lantern lock 100 also includes a clamp mechanism 110 which clamps at least a portion of the original socket assembly 104 supplied with the hanging lantern. The clamp device 110 includes a first clamp base 110*a* having a mounting stud 12 mounted thereon, and a second clamp base. A tightening mechanism 112 such as a screw tightens the clamp bases 110*a* and 110*b* together. The clamp device 110 may be used to clamp the socket assembly 104 (as shown in FIGS. 5D and 5E) or the power cord 26 (as shown in FIGS. 5A, 5B, and 5C) such that the frame 102 is fixedly positioned relative to the clamp device 110. The lantern lock 100, via the fixed mounting stud 12, then operates similarly to the embodiment shown in FIGS. 1A, 1B, 1C, 2, 3A, 3B, 4A, 4B, 4C, and 4D for interfacing with standard film and video production lighting equipment such as C stand gripheads.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. For example, it should be understood that the construction material of the mounting stud 12 and shade spreader may be variously embodied such as with aluminum or other metals, hard plastic, wood, etc. In addition, the light socket 22 may embodied to accommodate various types of light bulbs and more than one light bulb, the shade may be of various shapes and/or have various frame configurations, and the shade attachment may be otherwise embodied to securely hold the shade in accordance with the particular shade design. In addition, the accordion-style lantern shade may be configured in any of a number of various shapes, such as spherical or global, box-shaped, etc., and the shape and configuration of the lantern shade ribs may therefore vary from design to design. Further, although the invention has been shown used with an accordion-style lantern shade, the lantern lock of the invention may be adapted to support other lamp shade types and configurations. It is also possible that other benefits or uses of the currently disclosed invention will become apparent over time.

What is claimed is:

1. A lantern lock, comprising:

a socket assembly comprising a base, a threaded light bulb socket attached to said base, and a power cord electrically attached to said socket;

a mounting stud attached to said socket assembly, said mounting stud configured to be mountable in a griphead; and a spreading frame fixedly attached to said mounting stud, said spreading frame for holding a light shade in a fixed position, wherein said spreading frame comprises at least one hook positioned in proximity to said socket assembly base, at least one extension arm respectively having a first end and a second end wherein the first end is attached to and respectively extending from said at least one hook, and at least one retaining mechanism attached at said second end of said at least one extension arm.

2. A lantern lock in accordance with claim 1, wherein:

said shade comprises a collapsible accordion-style lantern shade having a plurality of ribs and flexible material attached to said ribs to allow said accordion-style lantern shade to expand from a collapsed position to an expanded position.

3. A lantern lock in accordance with claim 2, wherein:

said spreading frame is configured to be insertable into said accordion-style lantern shade to expand said accordion-style lantern shade to said expanded position and to retain said accordion-style lantern shade in said expanded position.

4. A lantern lock in accordance with claim 1, wherein:

said mounting stud comprises a hollow cylindrical tube wherein said power cord is threaded through said tube.

5. A lantern lock, comprising:

a socket assembly comprising a threaded light bulb socket and a power cord electrically attached to said socket;

a clamp which clamps at least a portion of said socket assembly;

a mounting stud attached to said clamp; and a spreading frame fixedly attached to said socket assembly, said spreading frame for holding a light shade in a fixed position.

6. The lantern lock of claim 5, wherein:

said portion of said socket assembly comprises said threaded light bulb socket.

7. A lantern lock in accordance with claim 6, wherein:

said shade comprises a collapsible accordion-style lantern shade having a plurality of ribs and flexible material attached to said ribs to allow said accordion-style lantern shade to expand from a collapsed position to an expanded position.

8. A lantern lock in accordance with claim 7, wherein:

said spreading frame is configured to be insertable into said accordion-style lantern shade to expand said accordion-style lantern shade to said expanded position and to retain said accordion-style lantern shade in said expanded position.

9. The lantern lock of claim 5, wherein:

said portion of said socket assembly comprises said power cord.

10. A lantern lock in accordance with claim 9, wherein:

said light shade comprises a collapsible accordion-style lantern shade having a plurality of ribs and flexible material attached to said ribs to allow said accordion-style lantern shade to expand from a collapsed position to an expanded position.

11. A lantern lock in accordance with claim 10, wherein:

said spreading frame is configured to be insertable into said accordion-style lantern shade to expand said accordion-style lantern shade to said expanded position and to retain said accordion-style lantern shade in said expanded position.

12. A lantern lock in accordance with claim 5, wherein:

said light shade comprises a collapsible accordion-style lantern shade having a plurality of ribs and flexible material attached to said ribs to allow said accordion-style lantern shade to expand from a collapsed position to an expanded position.

13. A lantern lock in accordance with claim 12, wherein:

said spreading frame is configured to be insertable into said accordion-style lantern shade to expand said accordion-style lantern shade to said expanded position and to retain said accordion-style lantern shade in said expanded position.

* * * * *